US006635840B1

(12) United States Patent
Mailloux

(10) Patent No.: US 6,635,840 B1
(45) Date of Patent: Oct. 21, 2003

(54) METHOD OF SORTING AND CATEGORIZING SEED

(75) Inventor: Louis Mailloux, Tilbury (CA)

(73) Assignee: Pioneer Hi-Bred International, Inc., Des Moines, IA (US)

( * ) Notice: Subject to any disclaimer, the term of this patent is extended or adjusted under 35 U.S.C. 154(b) by 0 days.

(21) Appl. No.: 09/529,830

(22) PCT Filed: Oct. 30, 1998

(86) PCT No.: PCT/IB98/01736

§ 371 (c)(1),
(2), (4) Date: Jul. 24, 2000

(87) PCT Pub. No.: WO99/22579

PCT Pub. Date: May 14, 2000

Related U.S. Application Data

(60) Provisional application No. 60/063,861, filed on Oct. 31, 1997.

(51) Int. Cl.[7] ..... B07C 5/00

(52) U.S. Cl. ..... 209/586; 209/587

(58) Field of Search ..... 209/586, 587, 209/938

(56) References Cited

U.S. PATENT DOCUMENTS

| | | | | | |
|---|---|---|---|---|---|
| 3,097,744 | A | | 7/1963 | Hutter et al. | |
| 3,410,403 | A | | 11/1968 | Adcox | |
| 3,530,372 | A | | 9/1970 | Laukien | |
| 3,603,457 | A | * | 9/1971 | Flodin et al. | 209/82 |
| 4,197,330 | A | | 4/1980 | Grimm | |
| 4,462,496 | A | | 7/1984 | Stafford | |
| 4,515,275 | A | * | 5/1985 | Mills et al. | 209/558 |
| 4,515,291 | A | | 5/1985 | Holmes | |
| 4,534,470 | A | * | 8/1985 | Mills | 209/585 |
| 4,538,735 | A | | 9/1985 | Boom et al. | |
| 4,586,613 | A | | 5/1986 | Horii | |
| 4,610,359 | A | | 9/1986 | Muller | |
| 4,624,367 | A | | 11/1986 | Shafer et al. | |
| 4,687,107 | A | | 8/1987 | Brown et al. | |
| 4,936,978 | A | | 6/1990 | Bortnikov et al. | |
| 4,946,045 | A | | 8/1990 | Ditchburn et al. | |
| 5,010,247 | A | | 4/1991 | Smith et al. | |
| 5,184,732 | A | | 2/1993 | Ditchburn et al. | |
| 5,305,895 | A | | 4/1994 | Hermann | |
| 5,733,592 | A | * | 3/1998 | Wettstein et al. | 426/416 |
| 5,903,341 | A | * | 5/1999 | Perry et al. | 356/237 |
| 6,044,779 | A | * | 4/2000 | Brown et al. | 111/185 |
| 6,325,005 | B1 | * | 12/2001 | Crabb et al. | 111/185 |

FOREIGN PATENT DOCUMENTS

| | | | |
|---|---|---|---|
| GB | 2301787 | | 12/1996 |
| JP | 59-145951 | * | 8/1984 |
| WO | WO 96/36208 | | 11/1996 |
| WO | WO 99/22579 | | 5/1999 |
| ZA | 98/9919 | | 1/2000 |

OTHER PUBLICATIONS

Finney, Jr., CRC Handbook of Transportation and Marketing in Agriculture, 1981, CRC Press, Boca Raton, Fl., vol. II, p. 127–157.*

(List continued on next page.)

*Primary Examiner*—Donald P. Walsh
*Assistant Examiner*—Joseph Rodriguez
(74) *Attorney, Agent, or Firm*—McKee, Voorhees & Sease, P.L.C.

(57) ABSTRACT

A method of sorting and categorizing seed departs from the traditional method of sorting based primarily on size of the seeds and instead sorts primarily on the basis of shape of the seeds. Sorted categories based primarily on shape can reduce the number of categories of the same type of seed that need to be packaged and inventoried. It simplifies warehousing, selection and planting of the seed. Optionally, the method can include sorting a substantial portion of a type of seed primarily by shape and sorting at least a portion of the remainder of the seed by traditional methods which also include size as a factor.

25 Claims, 5 Drawing Sheets

OTHER PUBLICATIONS

Copeland et al., Principles of Seed Science and Technology, 1985, Macmillan, NY, $2^{nd}$ ed, p. 191–200.*

Desai et al., Seeds handbook Biology, Production, Processing, and Storage, 1997, Marcel Dekker, Inc., NY, p. 487–497.*

Vaughan et al., Seed Processing and Handling, 1968, Seed Technology Laboratory, Mississippie State Univ., p. 79–161.*

Patent Abstract of Japan—vol. 14, No. 412(C–755); JP 02 157073A (Suzutec Co., Ltd.); Jun. 15, 1990.

Mezogazdasagi Lexikon L–Zs, Mezogazdasagi Kiado, Budapest, 1982. 755–756. oldal.

Patent Abstract of Japan—vol. 14, No. 412 (C–755); JP 02 157073A (Suzutec Co. Ltd.); Jun. 15, 1990 Abstract (1 pg).

* cited by examiner

METHOD OF SORTING AND CATEGORIZING SEED

This application claims the benefit of provisional application No. 60/063,861, filed Oct. 31, 1997.

BACKGROUND OF THE INVENTION

1. Field of the Invention

The present invention relates to seed. More particularly, though not exclusively, the present invention relates to a method of sorting and categorizing hybrid seed into different sub-products.

2. Problems in the Art

In the hybrid seed corn industry, seed is typically sorted and categorized into sub-products based on the size of the seed. When the seed is harvested, the seeds are sorted by size and packaged for sale in separate packages based on the size. When a customer buys seed for planting, the bag of seed will contain seed from one size category depending on the farmer's needs or preferences. However, across multiple locations and seed crop years, growing conditions commonly vary sufficiently to cause a range of size-out for a given hybrid of seed. As a result, throughout the life cycle of most hybrids, a range of sizes is produced. Typically, for most hybrids, approximately 7 sub-products comprise the total sample. Sometimes an 8th or 9th size for a given hybrid is produced for those products that exhibit a substantial size response to varying growing conditions. Each of these sizes and sub-products must be tracked and packaged individually by the seed company. Each must be kept separate through the entire process requiring unique space for computerization, warehousing, shipping, invoicing, and ultimately detailed customer efforts to achieve desirable planting in a field.

Another issue contributing to the growing complexity of inventory management in the seed corn business are so-called "technology products", or products of biotechnology and other scientific disciplines which bring rapid expansions to the seed corn line-up.

Since different customers have different preferences, a seed company may find itself selling approximately one half of its seed volume in non-preferred sub-products. This percentage may be significantly larger for hybrid seed at both ends of the seed size spectrum. For customers who are adaptable, this is not a large issue. However, many customers demand a certain seed size. To some customers, seed size preference ranks higher than the hybrid preference.

A need can therefore be seen for a system for sorting and categorizing seed which improves customer satisfaction and a seed company's efficiency.

Features of the Invention

A general feature of the present invention is the provision of a method for sorting and categorizing seed which overcomes problems found in the prior art.

A further feature of the present invention is the provision of a method for sorting and categorizing seed which involves sorting and categorizing seed based on the shape of the seeds.

Further features, objects and advantages of the present invention include:

A method for sorting and categorizing seed which divides the seeds into two general categories, flat and round.

A method for sorting and categorizing seed which reduces the total number of sub-products resulting in ease of use as growers seek consistency of sub-products across hybrids.

A method for sorting and categorizing seed which simplifies warehousing of the seed.

A method for sorting and categorizing seed which makes seed easier to fit into customers' sub-product preferences.

A method for sorting and categorizing seed which simplifies inventory management including conditioning, bagging, warehousing, initial shipping, and interplant shipment.

A method for sorting and categorizing seed which provides improved plantability through all planter types.

A method for sorting and categorizing seed which reduces the cost of managing and maintaining the sub-products.

A method for sorting and categorizing seed which eliminates undesirable size categories.

A method for sorting and categorizing seed which simplifies the sub-product system which makes future expansion through technology introductions more feasible.

These as well as other features, objects and advantages of the present invention will become apparent from the following specification and claims.

SUMMARY OF THE INVENTION

The method of sorting and categorizing seed of the present invention is a simple yet advanced system for dividing seed, for example corn, into logical sub-units for effective planting. Using seed shape rather than seed size as a primary determinate, the system avails many advantages. These advantages extend throughout many components of the seed delivery process, with significance for the customer, sales representatives, and seed companies.

DETAILED DESCRIPTION OF THE PREFERRED EMBODIMENT

Figure 1:
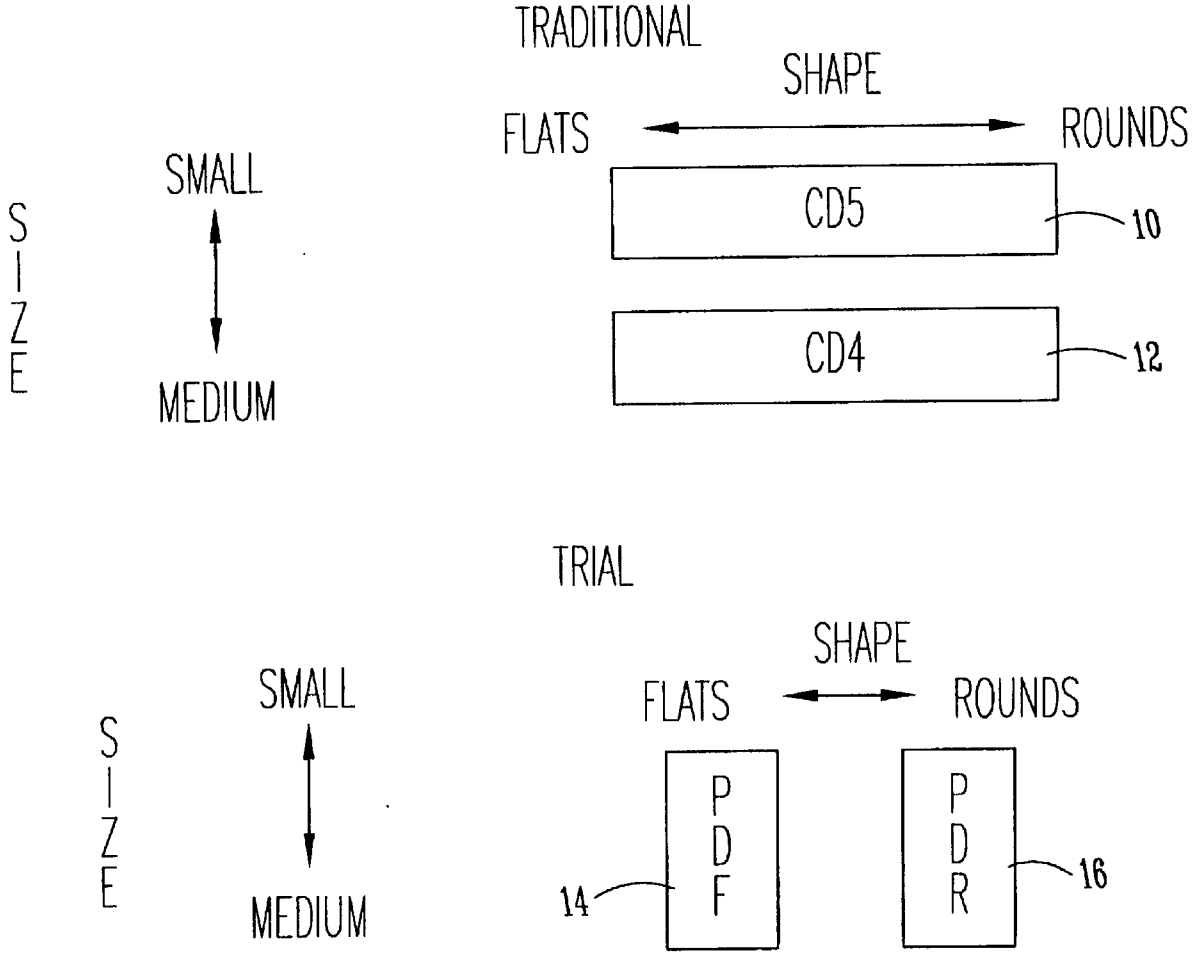
FIG. 1 is a diagram illustrating one example of a sizing system which utilizes seed shape.

The present invention will be described as it applies to its preferred embodiment. It is not intended that the present invention be limited to the described embodiment. It is intended that the invention cover all alternatives, modifications, and equivalencies which may be included within the spirit and scope of the invention.

As discussed above, in the prior art, hybrid corn seeds are sorted and packaged into many different sizes. Customers are often disappointed when a hybrid's "size-out" forces them to switch from their preferred choice. The many different seed sizes also presents invoicing and warehousing challenges for sales representatives, dealers, and employees. The present invention helps to consolidate the number of sub-products (sorted by size) in any particular hybrid from approximately 9 with prior art systems down to potentially 4 sub-products, with 75%–90% of the unit volume falling within two sub-products. These two sub-product categories include pilot design flat (PDF) and pilot design round (PDR). The PDF/PDR system of the present invention allows customers to have the same or similar accuracy as with the prior art system, while improving in some categories.

As is well known in the art, some seeds are sized and then categorized according to widely used category identifiers. For example, hybrid corn seeds are sized according to the following category identifications: F12, F13, F14, F15, F16, F17, R22, R23, R24, R25, R26, CD2, CD4, CD5. The letter F means the seed is relatively flat in shape. The letter R means the seed is relatively round in shape. The letters CD mean that the seed is mixture of relatively round and relatively flat seeds. In all cases, however, each category is sorted primarily based on the size of the seed. The number following the letter(s) F, R, or CD indicates the size of the seeds in that category. For example, F12 are the largest flat seeds, whereas F17 are the smallest flat seeds for those identified categories. R22 is the largest, and R26 the smallest round seeds for those identified categories. Even in the CD categories, although mixtures of flats and rounds, the number indicates the average size of seeds in the category; namely the average size of seeds in CD2 are the largest, and the average size of seeds in CD5 are the smallest of the above-listed identified categories. The precise sizing criteria for each of these categories is known in the art and will not be repeated here.

Most hybrid corn seeds fall with categories CD4, CD5, F14, F15, R23, and R24 (generally on the order of over 70% of the seeds, and many times in the range of 85% to 95%). Categories CD2, F13, and R22 can account for most of the remainder (for example, most of the remaining 5% to 15%). As is known in the art, categories CD2, F13, and R22 are on the large side of the spectrum of size of such seeds, and therefore, are generally preferred for mechanized planters that use a plate or disc to pick up seeds prior to delivery to the ground. Currently, under 10% of mechanized planters in use are these plate or disc planters. The remaining planters generally operate on air or vacuum or utilize a finger to pick up seeds.

Tables 3–6 list these basic seed size category identifiers in the context of comparing performance of planters with those traditional sorted seed sizes versus category identifications for seeds sorting according to the present invention.

As will be explained in more detail, the present invention can optionally use a few of the traditional categories (e.g. F13 and R22), but also uses the identifiers PDF and PDR. As can be appreciated, the present invention can be used to sort seeds that are best suited for or preferable to farmers with plate or disc planters. Therefore, categories F13 and R22 can be used with the present invention to supply such seeds for plate or disc planters, because farmers usually want larger seeds for these planters. However, these categories are sorted not only by size (i.e. the seeds are the relatively largest of the traditional categories), but also by shape (i.e. flats versus rounds).

Categories PDF and PDR, however, are primarily sorted by shape and actually end up with a mixture of seed sizes, generally in the range of medium to smaller in size. Air (or vacuum) or finger planters have been found to operate effectively with such a mixture, primarily based on shape not size.

FIG. 1 illustrates diagrammatically that prior art seed sorting (labeled "traditional") is based primarily on size and. The left side of the diagram of FIG. 1 illustrates a range of seed sizes (small to medium). Boxes 10 and 12 indicate the categories CD5 and CD4 when sorted. Even though each category CD5 and CD 4 includes a variety of shapes of seeds (e.g. flats and rounds), category CD5 (box 10) is characterized primarily by being comprised of seeds of the same size (relatively small). Category CD4 (box 12) is characterized primarily by being comprised of seeds of the same size (larger than CD5; and generally a medium average seed size).

In comparison seed sorting by the present invention, labeled "trial" in FIG. 1 takes in the seeds to be sorted but as indicated at boxes 14 and 16, sorts primarily on the basis of shape. Category PDF (box 14) comprises seeds of generally or relatively flat shape, but a mixture of sizes (e.g. from the smaller to the medium sizes). Category PDR (box 16) comprises seeds of generally or relatively round shape, but a mixture of sizes.

FIG. 1 therefore illustrates with a few examples the difference between traditional seed sorting (based primarily on seed size) and that of the invention (based primarily on seed shape).

Table 1 illustrates that PDF and PDR sorted seeds perform well with respect to stand count, doubles and skips, both generally and with respect to different planter types (plate, air, or finger). Table 1 also illustrates the same for two other categories of sorted seed that optionally can be used with the invention, namely traditionally categories F14 and R23. If PDF and PDR are used, along with sorting out F14 and R23, four total categories would be available. This reduces the number of categories from seven, eight, or sometimes nine to just four. As explained above, F14 and R23 might be used to have a supply of relatively large seeds, sorted by shape, available particularly for use with plate planters. Table 1 shows, however, that PDF and PDR operate with plate planters.

Table 2 illustrates the efficacy of PDF versus PDR by comparing seeds dropped per acre and stand count, doubles, and skips.

Table 3 is illustrating the efficacy of PDF and PDR, as well as F14 and R23, relative to the traditional categories based primarily on seed size (e.g. CD2, CD4, CD5, F13, F15, F16, R22, R24, R25, R26) for a given planter type (John Deere 7200) and different discs, showing all compare favorably. Table 4 shows the same for a John Deere 7000 planter. Tables 5 and 6 show the same for a Kinze planter and IH planter, respectively.

Figure 2:
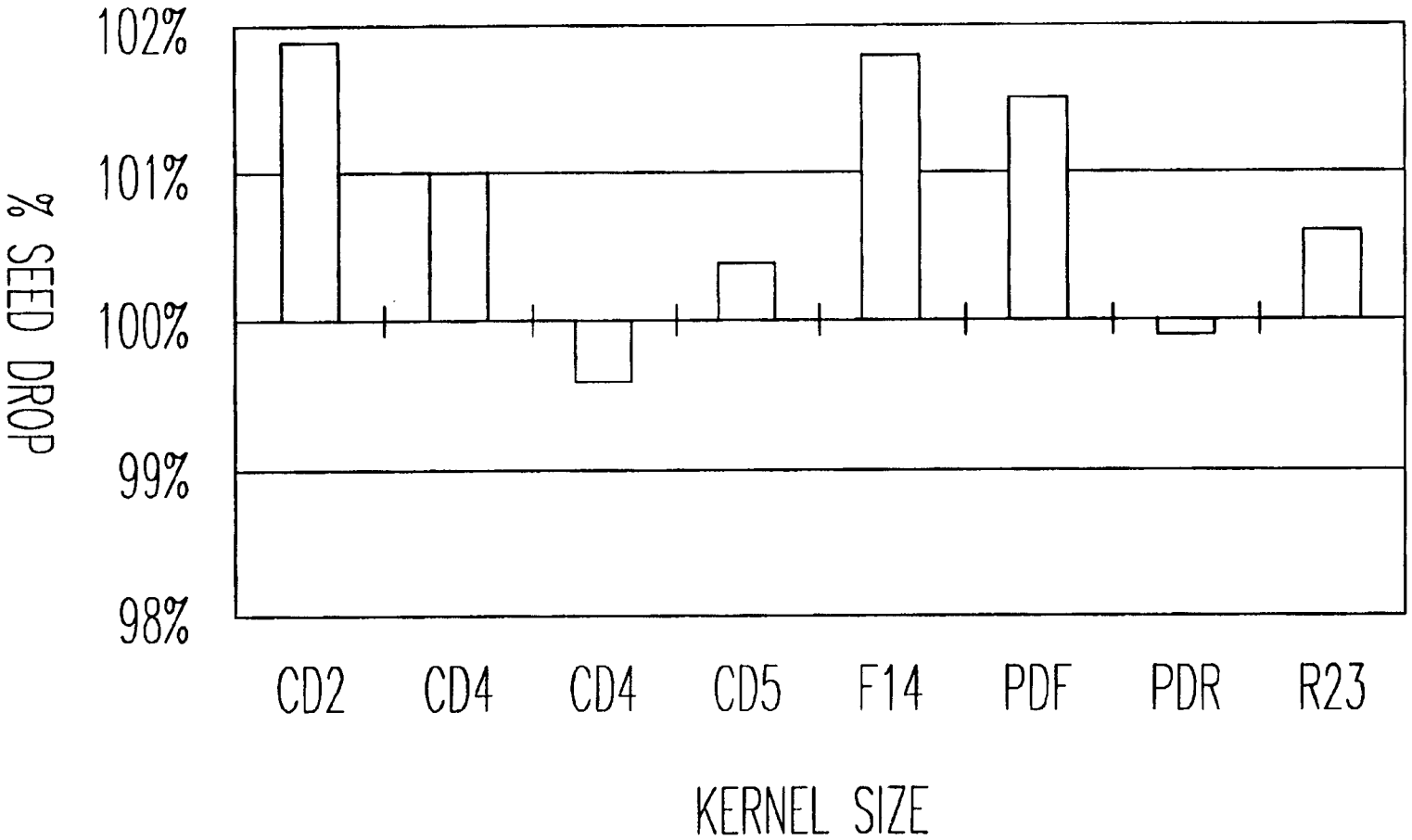
FIG. 2 illustrates a study on percentage of seed drop utilizing a Case-IH 800 Early Riser where the drum pressure was at 9 oz. for all samples except CD2 and CD4 where the drum pressure was at 11 oz.
Figure 3:
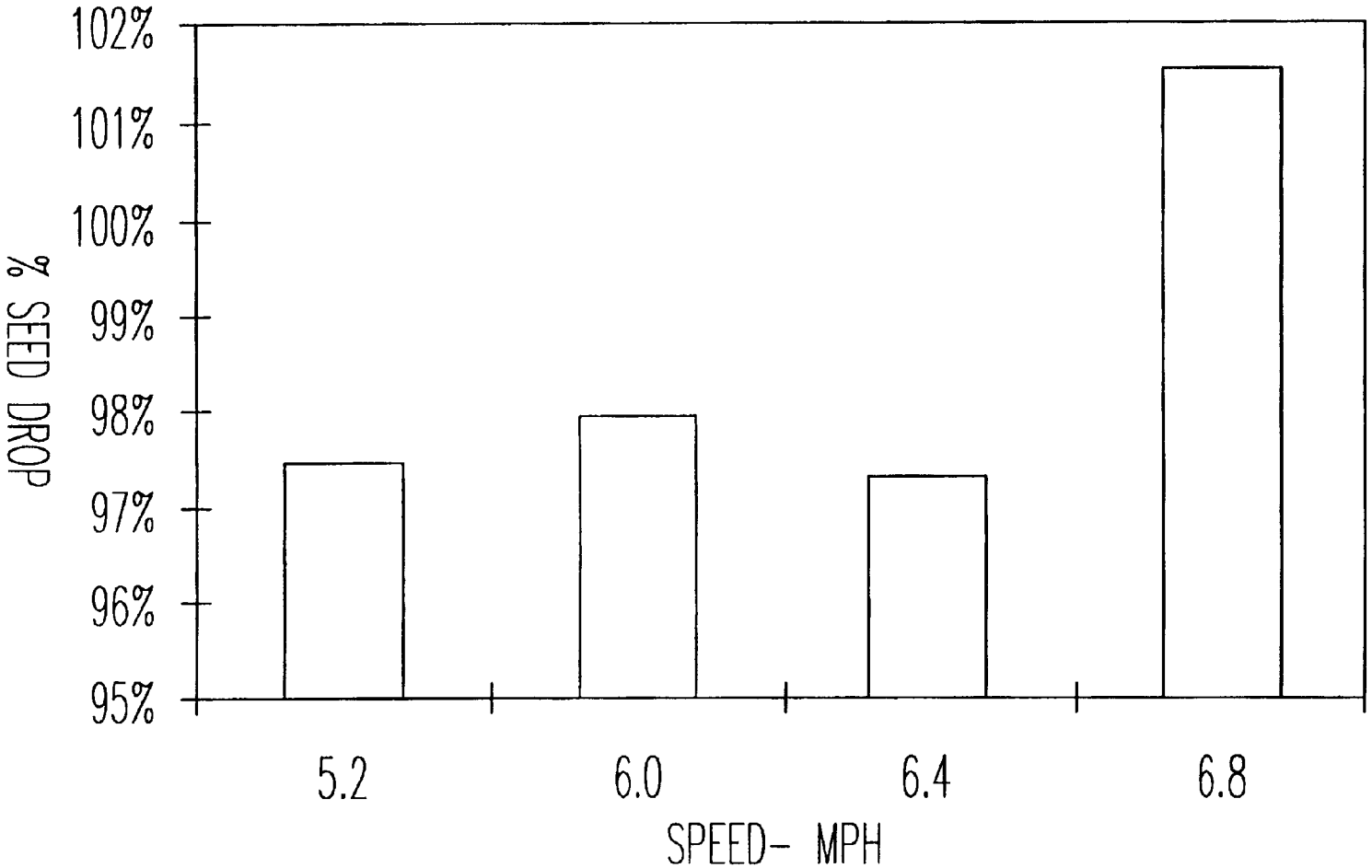
FIG. 3 illustrates a study of the effect of speed on seed drop utilizing a John Deere 7000 planter.
Figure 4:
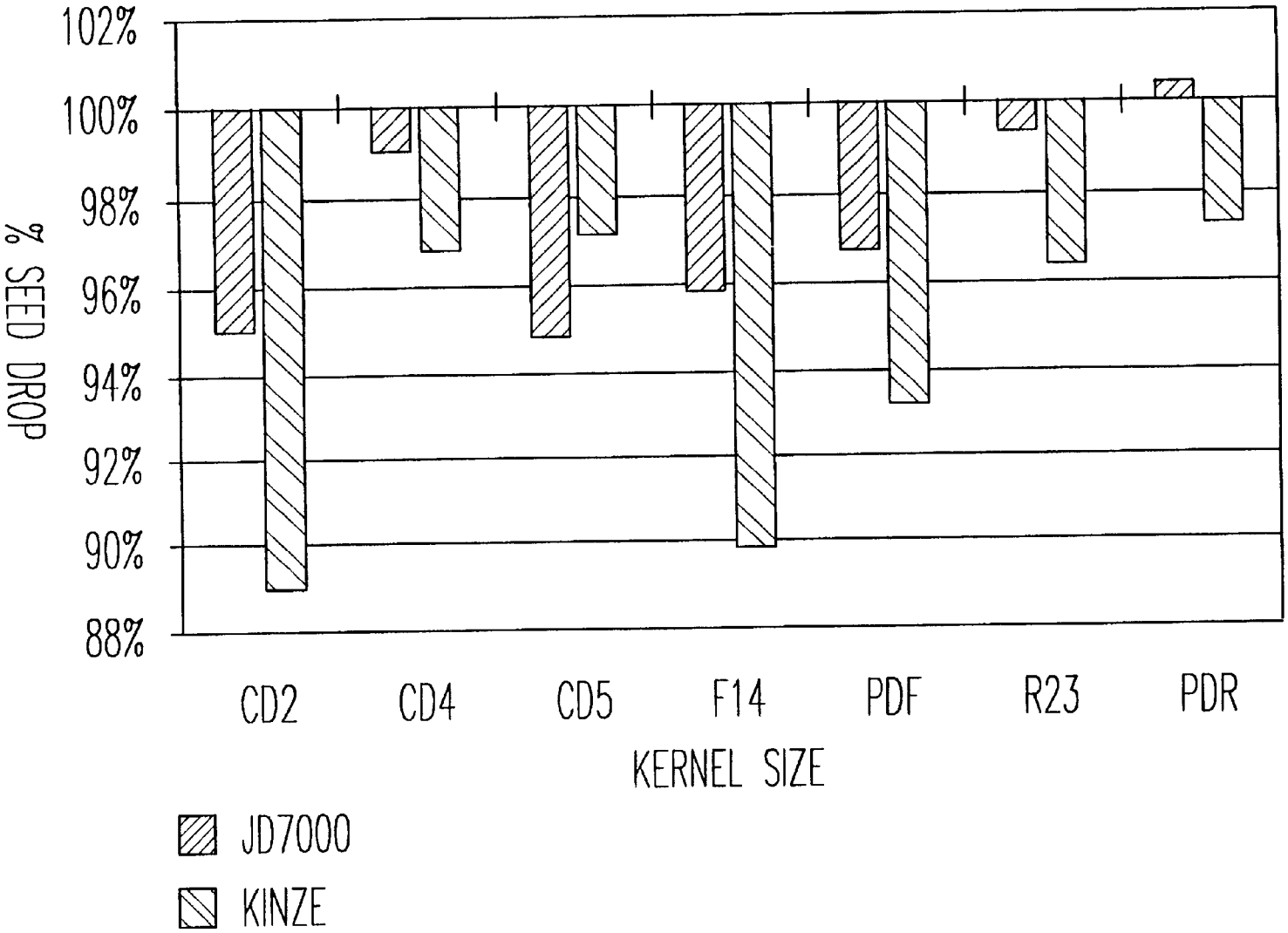
FIG. 4 illustrates a study comparing a John Deere 7000 (JD 700) and a Kinze planter for plantability in finer pickup units.
Figure 5:
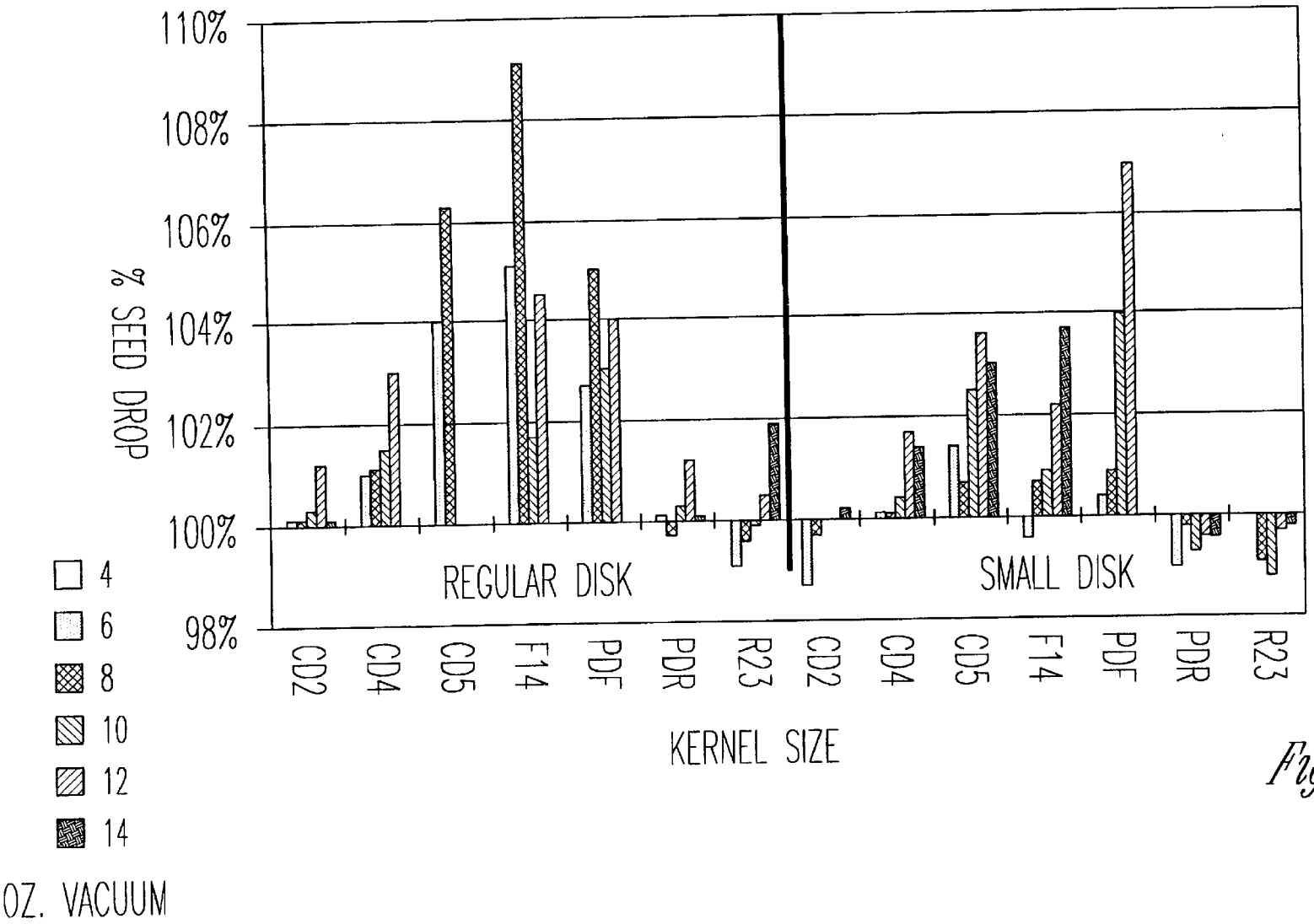
FIG. 5 illustrates a study of percent seed drop under varying ounces of vacuum for various kernel sizes.

FIGS. 2–5 are illustrations of the same points for different planters:

- FIG. 2 illustrates a study on percentage of seed drop utilizing a Case-IH 800 Early Riser where the drum pressure was at 9 oz. for all samples except CD2 and CD4 where the drum pressure was at 11 oz.
- FIG. 3 illustrates a study of the effect of speed on seed drop utilizing a John Deere 7000 planter.
- FIG. 4 illustrates a study comparing a John Deere 7000 (JD 700) and a Kinze planter for plantability in finer pickup units.
- FIG. 5 illustrates a study of percent seed drop under varying ounces of vacuum for various kernel sizes.

Tables 7 and 8 illustrate the same points for different planters, but show the data limited to seeds sorted according to PDF and PDR. They do not show direct comparisons with seeds sorted by traditional size categories.

With the emergence of new types of corn planters, the needs of users have evolved. Over time, relatively strong preferences of seed types have been developed by the users. Larger sized seeds are generally less desirable since they are packaged in 60,000 kernel count units (per bag) compared to 80,000 kernel count units which is standard. In addition, the larger size kernels require more handling since more bags and more overall weight are required per acre. On the other hand, smaller sized seed are generally considered by growers to be somewhat more difficult to plant accurately due to their small size. In general, small seed is perceived by users to be poorer quality.

Flat and round sizes work well with older-design plate-type planters. However, flat and round sizes also work well in plateless planters such as air planters or finger planters.

The pilot design seed (PDS) of the present invention divides the seed by shape while largely omitting consideration for the seed's size. FIG. 1 is a diagram illustrating one example of such a system. The present invention has several characteristics representing significant changes from prior art systems. As discussed above, seeds sorted and categorized under the system of the present invention result primarily in two sub-products, pilot design flats (PDF), and pilot design rounds (PDR). These two sub-products would comprise approximately 75%–90% of the seed for most seed hybrids. Of course, this percentage could vary. The remaining 10%–25% of the sample could be divided into traditional sub-products. The PDF and PDR sub-products demonstrate excellent interchangeability. In other words, a corn planter set up to plant PDF, with little or no adjustment, would also do a good job of planting PDR sub-products. These shape divided sub-products plant with good accuracy through plate-type planters, even though they are comprised of a mixture of medium to small kernel sizes. In addition, interchangeability between hybrids will be improved over the prior art helping to reduce the number of required disc changes.

Testing with the system of the present invention has revealed additional unexpected shifts from traditional thinking.

First, all hybrids may not fit the system perfectly. Hybrids which are small seeded, and give rise to PDF with 2,000 or more kernels per pound, may not plant with sufficient accuracy as PDF.

Second, as kernel counts approach 2,000 seeds per pound, excessive planting speeds may not be tolerable. The growers may have to abide more closely to planter manufacturers speed recommendations.

Third, throughout the life cycle of many hybrids, the most common number of sub-products per hybrid using the present invention will be four. Some hybrids may be offered in only two sub-products. Theoretically, hybrids with a narrow range of medium sized seed (no very large seed and no very small seed) could be offered as one sub-product for the entire hybrid.

Testing of the system of the present invention was conducted on a variety of planter brands and types including plate, finger and air-type planters. No adjustments whatsoever were made to any of the planters in transitioning from traditional sizes to the pilot design seed of the present invention. In field testing, no difficulties were encountered in the planting process. There were no issues of seed sorting in the seed box, or seed bridging. Testing of the emerged crop was also evaluated. Detailed stand counts compared total plant populations to targeted seed drop, frequency of skips, and frequency of doubles and triples. Tables 1 and 2 illustrate test data conducted with emerged crops.

In short, the PDS seed of the present invention performed very well. The PDS seed planted as well or better than traditional sizes. PDF appeared to perform as well as PDR. There was no distinguishable differences in results from plate, finger, or air-type planters.

Next, seed quality lab tests were conducted on a variety of hybrids. These tests were conducted for plate planters as well as finger and air-type planters. The hybrids were tested on a cross section of planter brands looking at a variety of common planter settings and speeds. Tables 3–6 and FIGS. 2–5 illustrate test results on a cross section of planters. In most cases, PDF performed as well as better than traditional sizes. PDR similarly compared very favorably. Tables 7 and 8 illustrate the plantability of PDF and PDR through plate planters. In summary, the plantability of PDF and PDR through plate planters is satisfactory. These two sub-products meet the needs of all planter types and provide accurate planting.

The basic discard rate at the time of conditioning (scalping/tipping) is essentially unchanged for the PDS system of the present invention as compared to the traditional approach. More importantly, due to the nature of the PDS approach, the percentage of undesirable sizes is greatly reduced or eliminated.

Increased warehouse utilization at seed company locations would be realized through PDS conditioning of the present invention. Warehouse utilization would be increased by storing less kernel sizes, resulting in more available warehouse space. Warehousing efficiency for the system of the present invention is largely impacted by the total number of sub-products in the system as compared to prior art systems. With more categories of sizes as found in the prior art, more dedicated rows in warehouses are required and there is more likelihood of incomplete rows and vacant floor space. In the prior art, the average number of sub-products per hybrid is about 6.55. In contrast, the average using the system of the present invention will be 4.0. A difference of 2.55 sub-products per hybrid across 100 main hybrids, for example, gives rise to a reduction in total subcategories of 459. The present invention therefore increases warehouse efficiency significantly.

The system of the present invention, as a result of the reduced average number of sub-products per hybrid, simplifies shipping in a variety of ways. First, interplant shipments, i.e. shipments between two different plants of the same seed company, can be reduced. For example, using the prior art sorting system, one particular company plant may produce certain sub-products of a hybrid, but may need to sell other sub-products (e.g., seeds of a different size) which are produced at another company plant. In that scenario, the sub-products would have to be shipped from the other company plant. Using the PDS system of the present invention, these interplanted units would be available within either PDF or PDR, thus eliminating this interplant situation. This results from the fact that PDR and PDF would comprise a high percentage of the total volume of seed. As a result, both sub-products would be produced at all production locations.

The present invention will also simplify inventory management to a significant extent as compared to prior art systems. This is primarily due to the consolidation of seed sizes into PDS.

The process of modifying conditioning towers to handle PDS may be required to practice the present invention. With the system of the present invention, up to 95% of the total seed volume will be destined for one of only two sub-products. Conditioning towers may have to be repiped to permit distribution of this high percentage of seed across all segments of the tower.

In the preferred embodiment, all PDF and PDR seeds will be packaged in 80,000 kernel units. All PDF seeds will be palletized in counts of 66 units per pallet. All PDR seeds will be palletized in counts of 54 units per pallet. Any remaining sub-products not falling within the PDR or PDF sub-products will be packaged in 60,000 kernel units in 66 count pallets.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention.

TABLE 1

Seed Sizing Study
3751 Field Test
Planter Types

| | # Locs | Finger PDF/PDR | Finger % Target | Finger # of Locs 9 % of Reg | Air PDF/PDR | Air % Target | Air # of Locs 9 % of Reg | Plate PDF/PDR | Plate % Target | Plate # of Locs 10 % of Reg |
|---|---|---|---|---|---|---|---|---|---|---|
| Standard Count | 28 | 30,225 | 100.7% | 97.1% | 29,506 | 99.9% | 98.0% | 27,243 | 94.9% | 102.7% |
| Doubles | 26 | 1,250 | — | 85.0% | 1,237 | — | 70.1% | 1,678 | — | 82.2% |
| Skips | 26 | 671 | — | 172.9% | 1,374 | — | 95.4% | 1,631 | — | 98.9% |
| Target Stand Count | | | 30,002 | | | 29,533 | | | 28,700 | |
| Stand Count | | F14/R23 | | 31,126 | | | 30,106 | | | 26,524 |
| Doubles | | F14/R23 | | 1,471 | | | 1,765 | | | 2,041 |
| Skips | | F14/R23 | | 388 | | | 1,441 | | | 1,649 |

TABLE 2

Seed Sizing Study
3751 Field Test
Comparisons by PDF vs PDR

| | # of Plots | SEEDS DROPPED/ACRES PDR | PDR | PDF/PDR | Reg | Target | Trial as % of Reg | Trial as % of Target | Reg as % of Target |
|---|---|---|---|---|---|---|---|---|---|
| Stand Count | 15 | 29,380 | | | 29,393 | 29,193 | 100.0% | 100.6% | 100.7% |
| | 13 | | 28,409 | | 28,879 | 29,623 | 98.4% | 95.9% | 97.5% |
| | 28 | | | 28,929 | 29,154 | 29,393 | 99.2% | 98.4% | 99.2% |
| Doubles | 15 | 1,509 | | | 1,897 | — | 79.5% | — | — |
| | 13 | | 1,271 | | 1,621 | — | 78.4% | — | — |
| | 28 | | | 1,399 | 1,769 | — | 79.1% | — | — |
| Skips | 15 | 1,348 | | | 1,248 | — | 108.0% | — | — |
| | 13 | | 1,115 | | 1,095 | — | 101.8% | — | — |
| | 28 | | | 1,240 | 1,177 | | 105.4% | | |

TABLE 3

Maxim Treated Lots
JD7200

| KS | Disc | Vacuum | # Tests | Maximum | Minimum | Average |
|---|---|---|---|---|---|---|
| CD2 | R | 6.0 | 30 | 1024 | 980 | 1001 |
| | R | 8.0 | 45 | 1016 | 930 | 997 |
| | R | 10.0 | 15 | 1030 | 960 | 1003 |
| | R | 12.0 | 21 | 1030 | 990 | 1012 |
| | R | 14.0 | 3 | 1010 | 1000 | 1003 |
| | S | 6.0 | 4 | 992 | 981 | 987 |
| | S | 8.0 | 15 | 1008 | 983 | 997 |
| | S | 10.0 | 20 | 1024 | 977 | 1000 |
| | S | 12.0 | 17 | 1008 | 994 | 1000 |
| | S | 14.0 | 11 | 1008 | 994 | 1002 |
| CD4 | R | 6.0 | 43 | 1028 | 980 | 1010 |
| | R | 8.0 | 30 | 1060 | 990 | 1011 |
| | R | 10.0 | 7 | 1030 | 1009 | 1015 |
| | R | 12.0 | 15 | 1060 | 1018 | 1030 |
| | S | 6.0 | 27 | 1015 | 993 | 1001 |
| | S | 8.0 | 30 | 1015 | 980 | 1001 |
| | S | 10.0 | 31 | 1020 | 980 | 1004 |
| | S | 12.0 | 18 | 1060 | 1000 | 1017 |
| | S | 14.0 | 3 | 1020 | 1010 | 1014 |
| CD5 | R | 4.0 | 1 | 1000 | 1000 | 1000 |
| | R | 6.0 | 22 | 1133 | 970 | 1040 |
| | R | 10.0 | 6 | 1110 | 1020 | 1063 |
| | S | 6.0 | 18 | 1080 | 1000 | 1014 |
| | S | 8.0 | 11 | 1050 | 930 | 1007 |
| | S | 10.0 | 2 | 1040 | 1010 | 1025 |
| | S | 12.0 | 7 | 1070 | 1010 | 1036 |

TABLE 3-continued

Maxim Treated Lots
JD7200

| KS | Disc | Vacuum | # Tests | Maximum | Minimum | Average |
|---|---|---|---|---|---|---|
| | S | 14.0 | 1 | 1030 | 1030 | 1030 |
| F13 | R | 6.0 | 4 | 1010 | 994 | 1000 |
| | R | 8.0 | 8 | 1030 | 997 | 1009 |
| | R | 10.0 | 1 | 1004 | 1004 | 1004 |
| | S | 12.0 | 3 | 999 | 996 | 997 |
| | S | 14.0 | 3 | 1004 | 1004 | 1004 |
| F14 | R | 6.0 | 26 | 1921 | 1000 | 101.6 |
| | R | 8.0 | 13 | 1090 | 1000 | 101.9 |
| | R | 10.0 | 3 | 1020 | 1010 | 1017 |
| | R | 12.0 | 6 | 1060 | 1030 | 1045 |
| | S | 6.0 | 20 | 1006 | 978 | 996 |
| | S | 8.0 | 22 | 1026 | 993 | 1007 |
| | S | 10.0 | 16 | 1060 | 990 | 1009 |
| | S | 12.0 | 7 | 1040 | 1007 | 1022 |
| | S | 14.0 | 2 | 1040 | 1034 | 1037 |
| F15 | R | 4.0 | 1 | 1000 | 1000 | 1000 |
| | R | 6.0 | 41 | 1046 | 820 | 1005 |
| | R | 8.0 | 5 | 1070 | 1008 | 1026 |
| | R | 10.0 | 10 | 1060 | 960 | 1022 |
| | R | 12.0 | 3 | 1050 | 980 | 1020 |
| | S | 6.0 | 22 | 1011 | 985 | 998 |
| | S | 8.0 | 33 | 1031 | 950 | 1003 |
| | S | 10.0 | 10 | 1060 | 970 | 1012 |
| | S | 12.0 | 14 | 1060 | 1000 | 1024 |
| | S | 14.0 | 2 | 1040 | 1030 | 1035 |
| F16 | R | 6.0 | 15 | 1104 | 1000 | 1039 |

TABLE 3-continued

| KS | Disc | Vacuum | Maxim Treated Lots JD7200 # Tests | Maximum | Minimum | Average |
|---|---|---|---|---|---|---|
| | R | 8.0 | 3 | 1070 | 1040 | 1057 |
| | R | 10.0 | 1 | 1060 | 1060 | 1060 |
| | S | 6.0 | 10 | 1045 | 986 | 1016 |
| | S | 8.0 | 8 | 1031 | 1000 | 1014 |
| | S | 10.0 | 3 | 1060 | 1010 | 1033 |
| | S | 12.0 | 4 | 1080 | 1020 | 1045 |
| PDF | R | 6.0 | 16 | 1083 | 980 | 1024 |
| | R | 8.0 | 9 | 1070 | 1010 | 1039 |
| | R | 10.0 | 2 | 1030 | 1030 | 1030 |
| | R | 12.0 | 3 | 1090 | 1040 | 1070 |
| | S | 6.0 | 12 | 1016 | 985 | 1003 |
| | S | 8.0 | 11 | 1028 | 970 | 1006 |
| | S | 10.0 | 10 | 1050 | 970 | 1019 |
| | S | 12.0 | 3 | 1070 | 1040 | 1053 |
| PDR | R | 6.0 | 5 | 1020 | 970 | 1001 |
| | R | 8.0 | 7 | 1001 | 980 | 997 |
| | R | 10.0 | 2 | 1010 | 1001 | 1006 |
| | R | 12.0 | 2 | 1030 | 980 | 1005 |
| PDR | R | 14.0 | 1 | 980 | 980 | 980 |
| | S | 6.0 | 1 | 990 | 990 | 990 |
| | S | 8.0 | 4 | 1006 | 994 | 998 |
| | S | 10.0 | 9 | 1007 | 950 | 993 |
| | S | 12.0 | 5 | 1000 | 990 | 996 |
| | S | 14.0 | 2 | 1001 | 990 | 996 |
| R22 | R | 6.0 | 1 | 1010 | 1010 | 1010 |
| | R | 8.0 | 7 | 1050 | 980 | 999 |
| | R | 10.0 | 5 | 1000 | 980 | 993 |
| | R | 12.0 | 3 | 1005 | 990 | 998 |
| | S | 12.0 | 1 | 991 | 991 | 991 |
| | S | 14.0 | 3 | 996 | 989 | 993 |
| R23 | R | 6.0 | 11 | 1008 | 994 | 991 |
| | R | 8.0 | 30 | 1003 | 950 | 996 |
| | R | 10.0 | 13 | 1014 | 980 | 999 |
| | R | 12.0 | 15 | 1010 | 990 | 1005 |
| | R | 14.0 | 16 | 1044 | 1002 | 1019 |
| | S | 8.0 | 1 | 991 | 991 | 991 |
| | S | 10.0 | 26 | 1004 | 930 | 988 |
| | S | 12.0 | 27 | 1010 | 960 | 997 |
| | S | 14.0 | 16 | 1010 | 970 | 998 |
| R24 | R | 6.0 | 19 | 1012 | 989 | 999 |
| | R | 8.0 | 28 | 1018 | 960 | 1000 |
| | R | 10.0 | 5 | 1005 | 1000 | 1002 |
| | R | 12.0 | 13 | 1028 | 990 | 1010 |
| | R | 14.0 | 3 | 1020 | 1010 | 1013 |
| | S | 6.0 | 1 | 994 | 994 | 994 |
| | S | 8.0 | 9 | 1001 | 963 | 993 |
| | S | 10.0 | 24 | 1007 | 950 | 994 |
| | S | 12.0 | 21 | 1010 | 970 | 1001 |
| | S | 14.0 | 14 | 1013 | 977 | 999 |
| R25 | R | 6.0 | 1 | 1009 | 1009 | 1009 |
| | S | 8.0 | 1 | 979 | 979 | 979 |
| | S | 10.0 | 1 | 1006 | 1006 | 1006 |
| R26 | R | 6.0 | 13 | 1050 | 990 | 1013 |
| | R | 8.0 | 2 | 1010 | 1002 | 1006 |
| | R | 10.0 | 2 | 1020 | 1010 | 1015 |
| | R | 12.0 | 2 | 1050 | 1020 | 1035 |
| R26 | S | 6.0 | 5 | 1007 | 980 | 992 |
| | S | 8.0 | 12 | 1010 | 960 | 993 |
| | S | 10.0 | 4 | 1005 | 990 | 1000 |
| | S | 12.0 | 4 | 1020 | 1000 | 1010 |
| | S | 14.0 | 1 | 1004 | 1004 | 1004 |

TABLE 4

| KS | Disc | RPM | Maxim Treated Lots JD7000 # Tests | Maximum | Minimum | Average |
|---|---|---|---|---|---|---|
| CD2 | | 65 | 22 | 988 | 895 | 956 |
| | | 75 | 53 | 1019 | 893 | 950 |

TABLE 4-continued

| KS | Disc | RPM | Maxim Treated Lots JD7000 # Tests | Maximum | Minimum | Average |
|---|---|---|---|---|---|---|
| | | 80 | 3 | 973 | 951 | 959 |
| | | 85 | 28 | 1053 | 960 | 996 |
| CD4 | | 65 | 23 | 997 | 930 | 976 |
| | | 75 | 56 | 1025 | 951 | 990 |
| | | 80 | 3 | 1017 | 1008 | 1011 |
| | | 85 | 26 | 1045 | 986 | 1017 |
| CD5 | | 65 | 11 | 1014 | 966 | 986 |
| | | 75 | 20 | 1069 | | 992 |
| | | 85 | 10 | 1141 | 1016 | 1060 |
| F13 | | 65 | 4 | 961 | 899 | 938 |
| | | 75 | 8 | 985 | 919 | 952 |
| | | 80 | 2 | 938 | 933 | 936 |
| | | 85 | 7 | 1021 | 927 | 982 |
| F14 | | 65 | 10 | 972 | 929 | 956 |
| | | 75 | 31 | 988 | 926 | 958 |
| | | 80 | 4 | 965 | 934 | 955 |
| | | 85 | 15 | 1011 | 957 | 990 |
| F15 | | 65 | 16 | 988 | 929 | 958 |
| | | 75 | 39 | 1016 | 919 | 964 |
| | | 85 | 19 | 1104 | 981 | 1014 |
| F16 | | 65 | 7 | 1009 | 957 | 981 |
| | | 75 | 13 | 1068 | 951 | 987 |
| | | 85 | 5 | 1129 | 993 | 1043 |
| PDF | | 65 | 2 | 972 | 957 | 965 |
| | | 75 | 10 | 991 | 952 | 967 |
| | | 80 | 3 | 970 | 962 | 965 |
| | | 85 | 5 | 1037 | 973 | 1000 |
| PDR | | 65 | 3 | 998 | 982 | 990 |
| | | 75 | 11 | 1019 | 988 | 1004 |
| | | 80 | 3 | 1005 | 992 | 998 |
| | | 85 | 6 | 1045 | 993 | 1018 |
| R22 | | 65 | 4 | 996 | 958 | 981 |
| | | 75 | 8 | 1008 | 953 | 985 |
| | | 80 | 2 | 967 | 960 | 964 |
| | | 85 | 6 | 1039 | 960 | 996 |
| R23 | | 65 | 15 | 1003 | 958 | 988 |
| | | 75 | 34 | 1016 | 962 | 993 |
| | | 80 | 4 | 988 | 993 | 995 |
| | | 85 | 19 | 1046 | 990 | 1014 |
| R24 | | 65 | 11 | 1008 | 981 | 991 |
| | | 75 | 34 | 1014 | 964 | 989 |
| | | 85 | 12 | 1035 | 1002 | 1017 |
| R25 | | 75 | 1 | 1010 | 1010 | 1010 |
| R26 | | 65 | 7 | 1007 | 999 | 1003 |
| | | 75 | 9 | 1032 | 989 | 1012 |
| | | 85 | 4 | 1065 | 1037 | 1051 |

TABLE 5

| KS | Disc | Maxim Treated Lots KINZE Tests | Maximum | Minimum | Average |
|---|---|---|---|---|---|
| CD2 | | 37 | 988 | 805 | 889 |
| CD4 | | 36 | 1003 | 917 | 968 |
| CD5 | | 9 | 993 | 949 | 971 |
| F13 | | 7 | 890 | 847 | 873 |
| F14 | | 28 | 962 | 848 | 897 |
| F15 | | 18 | 1000 | 817 | 896 |
| F16 | | 7 | 1003 | 927 | 950 |
| PDF | | 13 | 950 | 913 | 931 |
| PDR | | 13 | 987 | 954 | 972 |
| R22 | | 7 | 953 | 932 | 943 |
| R23 | | 26 | 985 | 933 | 963 |
| R24 | | 19 | 1001 | 931 | 952 |
| R25 | | 1 | 1012 | 1012 | 1012 |
| R26 | | 5 | 988 | 971 | 979 |

TABLE 6

| KS | Disc | Pressure | Maxim Treated Lots IH800 Tests | Maximum | Minimum | Average |
|---|---|---|---|---|---|---|
| CD2 | | 11.0 | 24 | 1050 | 990 | 1019 |
| CD4 | | 9.0 | 25 | 1050 | 975 | 1010 |
| | | 11.0 | 1 | 996 | 996 | 996 |
| CD5 | | 9.0 | 11 | 1020 | 980 | 1004 |
| F13 | | 9.0 | 4 | 1010 | 1000 | 1005 |
| F14 | | 9.0 | 11 | 1050 | 1000 | 1018 |
| F15 | | 9.0 | 20 | 1050 | 991 | 1009 |
| F16 | | 9.0 | 7 | 1020 | 991 | 1006 |
| PDF | | 9.0 | 2 | 1030 | 1000 | 1015 |
| PDR | | 9.0 | 3 | 1000 | 999 | 999 |
| R22 | | 9.0 | 4 | 1010 | 993 | 1001 |
| R23 | | 9.0 | 15 | 1020 | 1000 | 1006 |
| R24 | | 9.0 | 16 | 1020 | 996 | 1007 |
| R26 | | 9.0 | 7 | 1020 | 1000 | 1003 |

TABLE 7

Plate Planter Test Results for PDF and PDR Sizes(1)

| HYBRID LOT | KS | K/LB | JD PLATE | JD RESULT | IH PLATE | IH RESULT |
|---|---|---|---|---|---|---|
| 3162 C52JEA | PDF | 1755 | B9-24X | 1001 | C9-24 | 999 |
| | PDR | 1603 | B2-24 | 1047 | C2X-24 | 1014 |
| 3223 P20JAC | PDF | 2012 | B9-24 | 1038 | C9-24 | 1032 |
| | PDR | 1820 | B25-24 | 1025 | C25-24 | 1027 |
| 3335 P222JBGG | PDF | 2088 | B190-24 | 1052 | C9-24 | 1060 |
| | PDR | 1912 | B3-24 | 1013 | C3-24 | 1013 |
| 3489 P24JBE | PDF | 1636 | B6-24 | 1002 | C697-24 | 1020 |
| | PDR | 1476 | B150-24 | 1014 | C2X-24 | 992 |
| 3496 P13JAC | PDF | 2132 | B9-24 | 1044 | C9-24 | 1038 |
| | PDR | 1732 | B150-24 | 1083* | C2X-24 | 1014 |
| 3559 P24JBK | PDF | 2192 | B19-24 | 1030 | C190-24 | 989 |
| | PDR | 1946 | B3-24 | 1001 | C3-24 | 1021 |
| 3563 P87JDN | PDF | 1944 | B9-24 | 1025 | C9-24 | 1016 |
| | PDR | 1756 | B25-24 | 1004 | C25-24 | 1016 |
| 3573 | PDF | 2249 | B6-24X | 1041 | C697-24 | 1050 |
| | | | B9-24X | 972 | C9-24 | 963 |
| | PDR | 2085 | B150-24 | 1037 | C2X-24 | 1010 |
| (2)3751 P11JGC | PDF | 2003 | B6-24 | 1002 | C697-24 | 1023 |
| | PDR | 1696 | B150-24 | 1013 | C150-24 | 1035 |
| 3893 C11JGF | PDF | 2047 | B9-24X | 1006 | C9-24 | 1032 |
| | PDR | 1824 | B25-24 | 1004 | C2X-24 | 1020 |

*Best plate found, sorting noted with smaller plate.
(1)Maxim + Apron treatment except as noted(1)
(2)Captan + Apron treatment

TABLE 8

Plate Planter Test Results for PDF and PDR Sizes
Canadian Results — All Treated With Captan/Apron

| Hybrid Lot | KS | K/LB | JD Plate | JD Result | IH Plate | IH Result |
|---|---|---|---|---|---|---|
| 3752 | PDF | 1897 | B6-24 | 1049 | C697-24 | 1023 |
| C51JBE | PDR | 1609 | B150-24 | 1015 | C150-24 | 1048 |
| 3984 | PDF | 1713 | B6-24 | 989 | C697-24 | 1016 |
| C5JBY | PDR | 1612 | B1-24X | 995 | C1X-24 | 1021 |
| 3515 | PDF | 1748 | B7-24X | 1040 | C7-24X | 1050 |
| C51JBA | PDR | 1587 | B1-24X | 1045 | C2X-24 | 1045 |
| 3820 | PDF | 2066 | B9-24 | 1002 | C9-24 | 1004 |
| C87JEX | PDR | 1834 | B25-24 | 1021 | C25-24 | 1003 |
| 3860 | PDF | 1909 | B6-24 | 1020 | C697-24 | 1056 |

TABLE 8-continued

Plate Planter Test Results for PDF and PDR Sizes
Canadian Results — All Treated With Captan/Apron

| Hybrid Lot | KS | K/LB | JD Plate | JD Result | IH Plate | IH Result |
|---|---|---|---|---|---|---|
| C51JBK 3893 | PDR | 1713 | B150-24 | 1045 | C2X-24 | 1040 |
| C51JBN | PDF | 1938 | B6-24 | 1035 | C697-24 | 1060 |
| C51JCN | PDR | 1711 | B150-24 | 1035 | C2X-24 | 1006 |
| 3970 | PDF | 1833 | B7-24X | 1020 | C7-24X | 1057 |
| C51JBX | PDR | 1664 | B1-24X | 1030 | C150-24 | 1050 |

What is claimed is:

1. A method for sorting and categorizing seed of the same variety of an agricultural crop of the type plantable by a mechanized planter comprising:

(a) collecting a quantity of the variety of seed;

(b) sorting at least a substantial portion of the quantity into a plurality of categories based principally on differences in seed shape as opposed to seed size, each said category containing seed of similar shape but a range of seed sizes;

(c) maintaining said plurality of categories segregated from one another in preparation for planting by a mechanized planter.

2. The method of claim 1 wherein the substantial portion comprises a first subset of the quantity of seed, the first subset comprising a range of seed sizes between largest and smallest of the quantity.

3. The method of claim 2 further comprising sorting a second subset of the quantity, the second subset comprising seed sizes at or near the largest of the quantity.

4. The method of claim 3 wherein the sorting of the second subset of the quantity is based principally on differences in seed shape.

5. The method of claim 4 further comprising sorting the second subset additionally based on seed size.

6. The method of claim 3 further comprising segregating a third subset of the quantity, the third subset comprising seed sizes at or near the smallest of the quantity.

7. The method of claim 1 wherein the variety is defined by the type of plant that will grow from the seed.

8. The method of claim 7 wherein the variety is defined by a hybrid.

9. The method of claim 1 wherein the mechanized planter is the type that includes a seed singulation and delivery method.

10. The method of claim 9 wherein the seed singulation and delivery method utilizes a plate or disc, air or vacuum, or a finger mechanism.

11. The method of claim 1 wherein the agricultural crop comprises an agricultural crop with seed comprising a relatively large or coarse grain.

12. The method of claim 11 wherein the relatively large or coarse grain is corn.

13. The method of claim 12 wherein the variety is a hybrid.

14. The method of claim 12 wherein the sorting based principally on shape distinguishes between relatively flat seed and relatively round seed.

15. The method of claim 12 wherein the substantial portion comprises a majority of the quantity.

16. The method of claim 15 wherein the majority of the quantity comprises approximately 70% or more of the quantity.

17. The method of claim 12 wherein the quantity is sorted into 7 or less categories.

18. The method of claim 12 wherein the quantity is sorted into 4 or less categories.

19. The method of claim 12 wherein the substantial portion is sorted into two categories.

20. A method according to claim 12 further characterized by (a) segregating from the quantity (a1) a first portion for sorting and categorizing according to the method of claim 1, (a2) a second portion of the quantity comprising at least some relatively larger seed and sorting the second portion principally on shape into one or more other categories seed of different sizes, and (a3) a third portion of the quantity comprising relatively small seed; (b) packaging seed in each category sorted according to claim 1 into generally uniform seed counts; (c) so that some of the largest packaged seed are categorized and can be warehoused for selection based primarily on shape of the seed, and the remainder of packaged seed, of various sizes, are categorized and can be warehoused for selection based primarily on shape of the seed, to minimize the sorted categories of the quantity compared to sorting based principally on size.

21. The method of claim 1 wherein the step of maintaining the categories comprises packaging seed of a category into one or more packages.

22. The method of claim 21 wherein the packages comprise relatively uniform seed count.

23. The method of claim 21 wherein the step of maintaining the categories comprise packaging seed of different categories into one or more packages, packages of different categories comprising relatively different seed counts.

24. The method of claim 21 further characterized by warehousing the packages according to categories.

25. The method of claim 24 wherein said warehousing is characterized by providing a warehouse having a defined storage space; establishing a plurality of designated locations in the warehouse; and placing at each location one or more a packages of a category.

* * * * *